US005079895A

United States Patent [19]

Sinki

[11] Patent Number: 5,079,895

[45] Date of Patent: Jan. 14, 1992

[54] METHOD TO REMOVE A DEPRESSION IN A FLOOR AND PREVENT RECURRENCE OF THIS DEPRESSION THEREAFTER

[76] Inventor: Gamil Sinki, 3955C Isabelle, Brossard, Québec, Canada, J4Y 2R2

[21] Appl. No.: 551,166

[22] Filed: Jul. 11, 1990

[51] Int. Cl.[5] ..... E04B 2/54

[52] U.S. Cl. ..... 52/743

[58] Field of Search ..... 52/743

[56] References Cited

FOREIGN PATENT DOCUMENTS 1210605 9/1986 Canada .

*Primary Examiner*—David A. Scherbel
*Assistant Examiner*—Michele A. Van Patten
*Attorney, Agent, or Firm*—Robic

[57] ABSTRACT

A method to remove a depression in a floor extending on top of a supporting underfloor and to prevent recurrence of this depression thereafter, the method comprising: a) determining the pressure that the floor may withstand in use; b) preloading the floor by exerting onto the depression in the floor a pressure at least equal to the pressure determined in step (a), using, for example, dead weights to do so; c) injecting an expandable polymeric foam in an unexpanded state beneath the depression in the preloaded floor between this floor and the supporting underfloor and allowing the foam to expand and level the floor until the depression is removed; and d) releasing the pressure exerted onto the floor after the depression is removed. The pressure exerted onto the floor in step (b) exerts a compressive strength to both the foam injected beneath the floor and the supporting underfloor. Such a compressive strength in turn causes the foam to reach a density sufficient to withstand any further pressure that could subsequently be exerted onto the floor, while it also ensures that the underfloor is stable enough not to sink.

16 Claims, 2 Drawing Sheets

METHOD TO REMOVE A DEPRESSION IN A FLOOR AND PREVENT RECURRENCE OF THIS DEPRESSION THEREAFTER

BACKGROUND OF THE INVENTION

A process has been developed to remove a depression in a floor, particularly a concrete floor, by which comprises injecting under the floor polyurethane foam until the floor reaches the desired level. Such a process is described for instance in Canadian patent 1,210,605 dated 86.09.02 as invented by HAKKINEN.

It has been found however, that if one follows the teaching of merely injecting polyurethane, problems arise and the floor has a tendency to sink again in certain circumstances, particularly when heavy loads are exerted on concrete floors.

THE INVENTION

The present invention aims at overcoming recurrent depressions.

Broadly stated, the invention is directed to a method to remove a depression in a floor extending on top of a supporting underfloor and to prevent recurrence of this depression thereafter, the method comprising:

a) predetermining the pressure that the floor should withstand in use;

b) preloading the floor by exerting onto the depression in the floor a pressure at least equal to the pressure determined in step (a), using, for example, a load to do so;

c) injecting an expandable polymeric foam in an unexpanded state beneath the depression in the preloaded floor between this floor and the supporting underfloor until the depression is removed; and d) releasing the pressure exerted onto the floor after the depression is removed, whereby the pressure exerted onto the floor in step (b) exerts a compressive strength to both the foam injected beneath the floor and the supporting underfloor, such a compressive strength causing the foam to reach a density sufficient to withstand any further pressure that could subsequently be exerted onto the floor, while also ensuring that the underfloor is stable enough not to sink.

Thus, the invention is directed to a method to remove and prevent recurrence of a depression in a floor, comprising exerting on said floor a pressure at least equivalent, and preferably greater than that which the floor should withstand, injecting the components of an expandable polymeric foam below the floor until the level of said floor reaches a desired level, thereby obtaining the density of the foam which is such as to withstand at least the compressive strength required of said floor. Normally a security factor such as 10% variation has to be envisaged.

As can easily be seen, Applicant's method is not concerned with merely raising the level of a floor but in ensuring that the future pressures expected to be exerted on the floor will not unduly create sinking.

The floor must be under compression conditions when the foam is injected, as otherwise, the floor would tend to raise above a desired level without the foam reaching the required density.

The invention is also directed to a floor comprising a foam thereunder having a density of about 5 to 10 pound per cubit foot.

DRAWINGS

In the drawings which illustrate particular embodiments of the invention,

FIG. 1 is a schematic view illustrating a floor under compression being treated with a foam, FIG. 2 is a typical curve illustrating the effect of density versus the compressive strength, the abscissa represents the density in pounds per square feet in the lower part and in kilograms per cubic meters in the upper part and the ordinate the compressive strength in PSI on the left hand side and in mega Pascal on the right hand side, for a given polyurethane.

DETAILED DESCRIPTION OF THE INVENTION

Figure 1:
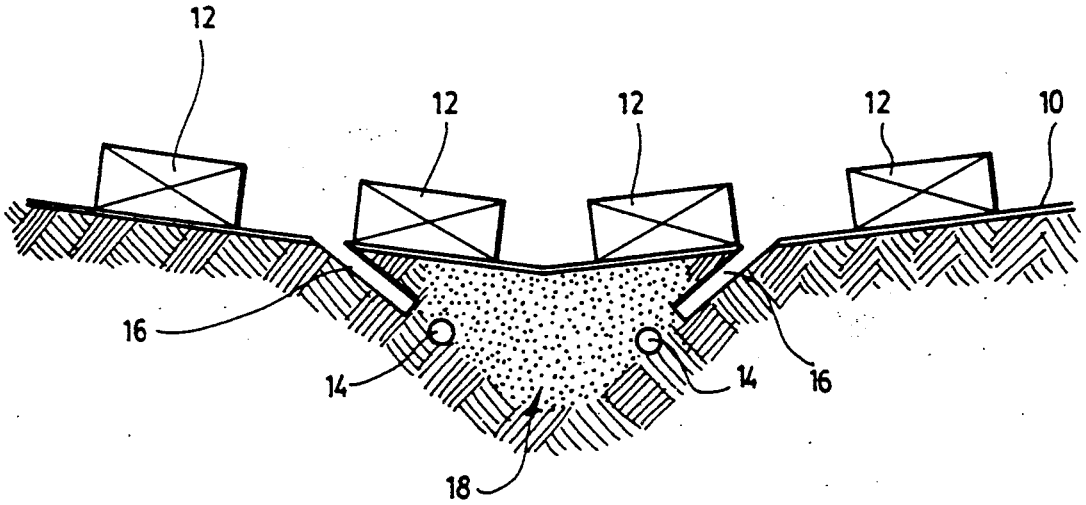
Figure 2:
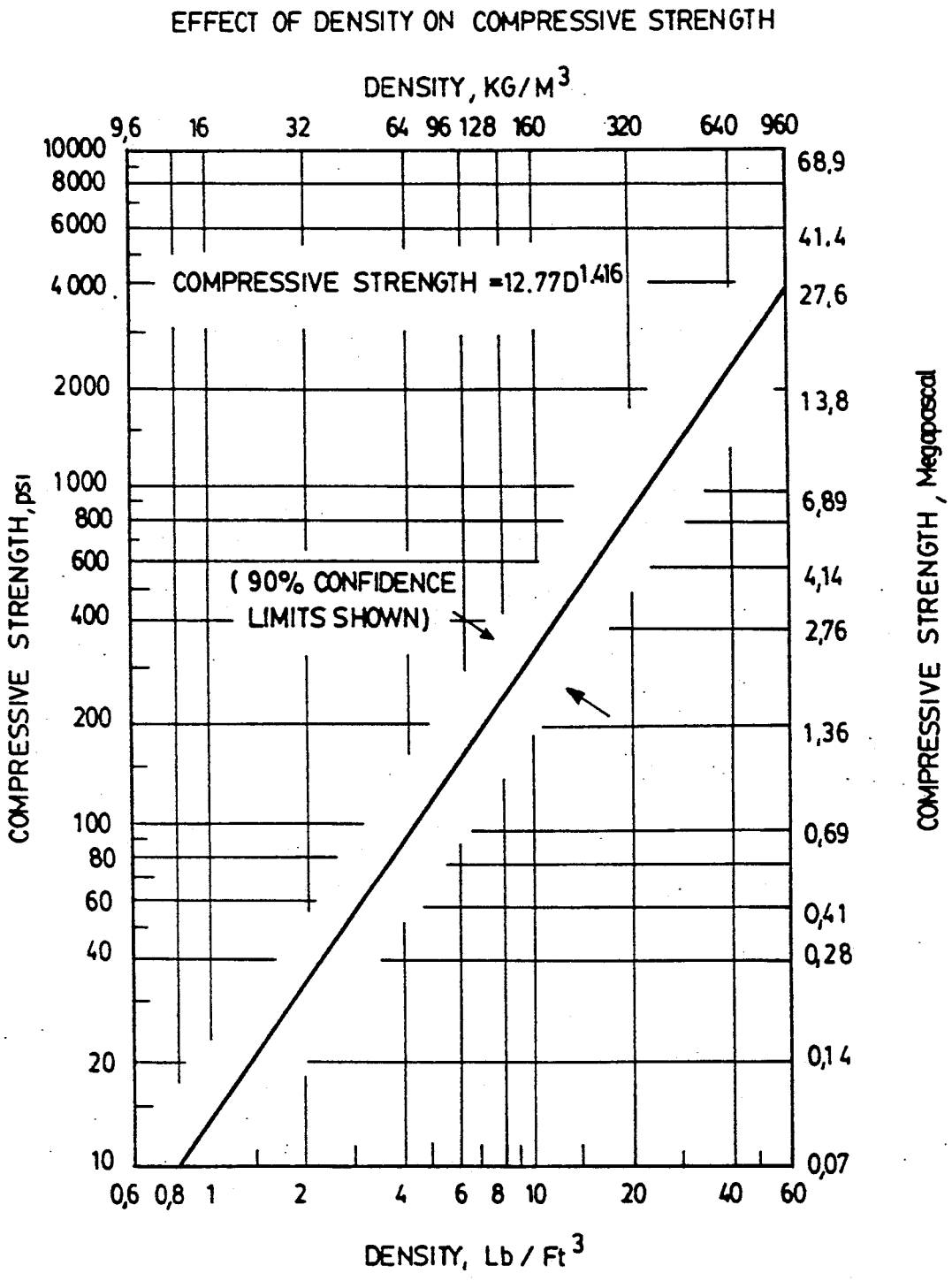

As shown on FIG. 1, a foam product 18 is injected under a floor 10 having a depression to be removed, on which compressing loads 12 have been previously positioned, using a gun inserted into different holes 14, 16, to do so.

Normally, under a floor such as a concrete floor, where a main depression is to be removed, a hole is drilled so that it preferably reaches the center of the depression; the compressing loads are added preferably over said main depression, and then, a polymeric foam is injected, preferably at the center of the depression and of the added loads.

The holes that are drilled are, for example sake, of the order of half an inch: the holes should be of a size to tightly receive the nozzle of the gun delivering the polymeric foam to be injected, and should conform said nozzle so that there is no loss in pressure between said gun and its surrounding, but that all the pressure is used to penetrate under the floor to be strengthened or raised.

The length of the holes should be as short as possible and preferably should not exceed a meter.

If the polymeric foam tends to solidify too rapidly, pressure and temperature could be raised to alleviate the problem.

Once a hole is fed with the polymeric foam, and setting occurs, the hole thereby becomes sealed. Then, another hole could be opened to repeat the operation until the floor is at the right height and have the desired density, making sure that the levelling is accomplished smoothly as to prevent any break or disruption in the floor which could result by abrupt uneven elevation of the floor.

Conveniently also, the drilling is conducted in between loads 12 to disperse foam from the space under the floor located about the middle of a load.

The foam may be injected with a high pressure gun.

In the case of polyurethane, normally, the isocyanate is mixed with the polyols just before injecting. The two components also comprise other conventional elements such as catalysts. Once injected, the reaction is fairly rapid. However, the lifting of the floor that occurs when the density of the foam, which slowly increases, reaches a value where its compressive strength is equal to that exerted by the loads, is so gradual that it is hardly noticeable, so much so that a level measurement is generally used to ensure that the floor does not exceed the desired level. Normally a large amount of polyurethane is used at the beginning of the method, and then smaller amounts near the end of the operation to reach the final level by small increments. Once the desired level is reached, setting of the foam, such as polyurethane, is a matter of minutes. Then the compressive loads used to compress the floor may by removed and the floor may be used for its regular activities.

The polyurethane foam when used in its liquid state may be pumped with pressure that may range for instance between 1 000 to 3 000 PSI. The foam to be injected is preferably dispersed through the center of the depression by drilling the holes at a proper angle in order to allow the foam to reach the desired center. The polyurethane should be chlorofluorocarbon and ozone free to respect the environment.

The polyurethane is preferably fed or injected at a pressure of 1 100 to 1 200 PSI, that is when the components are injected in their unexpanded state.

As a typical example of polyol is a polyol available under the trade name P5353 containing a catalyst. As a typical example of isocyanates that may be used is for example diphenyl methane diisocyanate 4,4 these are sold under the trademark MDI-FSA by Foamseal Inc., Oxford, Mich., U.S.A.

In order to increase the foam density any compatible means to apply a mechanical or hydraulic pressure on the surface to be consolidated, may be used. For instance the floor may be loaded with dead weights of high density such as ciment blocks, metal ingots or any available local packaged products on skids.

Unless one wishes to create special zones of high compressing strength, preferably the load is homogeneously distributed on the floor, with spaces therebetween to allow equipment for the insertion of the polymeric foam and the drilling prior thereto.

The foam density may be of the order of 5 to 60 and preferably 5 to 10 pounds per cubic feet.

Typical examples of floor include but are not limited to house, appartment and shopping center basements, roads, sidewalks, pot holes, areas to overcome sheet of water, dams, weirs, mining areas.

Although the present invention has been explained hereinabove by way of preferred embodiments thereof, it should be pointed out that any modifications to these preferred embodiments, within the scope of the appended claims, is not deemed to change or alter the nature and scope of the invention.

The embodiments of the invention in which an exclusive property or privilege is claimed are defined as follows:

1. A method to remove a depression in a floor extending on top of a supporting underfloor and to prevent recurrence of said depression thereafter, said method comprising:

a) predetermining the pressure that the floor should withstand in use;

b) preloading said floor by exerting onto said depression in the floor a pressure at least equal to said predetermined pressure;

c) injecting an expandable polymeric foam in an unexpanded state beneath said depression in said preloaded floor between said floor and the supporting underfloor until said depression is removed; and d) releasing the pressure exerted onto the floor after said depression is removed, whereby the pressure exerted onto the floor in step (b) exerts a compressive strength to both the foam injected beneath said floor and the supporting underfloor, said compressive strength causing said foam to reach a density sufficient to withstanding any further pressure that could subsequently be exerted onto the floor, while also ensuring that the supporting underfloor is stable enough not to sink.

2. A method according to claim 1, wherein said foam is a polyurethane foam.

3. A method as defined in claim 1, wherein said floor is a concrete floor.

4. The method as defined in claim 1, wherein the pressure exerted to the floor in step (b) is greater than the pressure determined in step (a) that the floor should withstand.

5. The method as defined in claim 1, wherein said pressure exerted to said floor in step (b) is a mechanical pressure.

6. The method as defined in claim 1, wherein said pressure exerted to said floor in step (b) is a hydraulic pressure.

7. The method as defined in claim 1, wherein said pressure exerted to said floor in step (b) is obtained with dead weights.

8. A method to remove a depression in a floor extending on top of a supporting underfloor, and to prevent recurrence of said depression thereafter, said method comprising:

a) predetermining the load that the floor should support in use;

b) preloading the floor with a load at least equal to said predetermined load, said load being positioned onto the floor above said depression;

c) injecting an expandable polymeric foam in an unexpanded state beneath said depression in said preloaded floor between said floor and the supporting underfloor until said depression is removed; and d) removing said load positioned onto the floor in step (b) after said depression is removed, whereby the load positioned onto the floor in step (b) exerts a compressive strength to both the foam injected beneath said floor and to the supporting underfloor, said compressive strength causing said form to reach a density sufficient to withstand any further load that could subsequently be supported by the floor while also ensuring that the supporting underfloor is stable enough not to sink.

9. A method according to claim 8, wherein said foam is a polyurethane foam.

10. A method as defined in claim 8, wherein said floor is a concrete floor.

11. The method as defined in claim 8, wherein said load consists of cement blocks.

12. The method as defined in claim 8, wherein said load consists of metal ingots.

13. The method as defined in claim 8, wherein a foam density of 5 to 10 pounds per cubic foot is obtained.

14. The method as defined in claim 8, wherein step (c) comprises:

drilling under the floor a hole to reach the center of the depression, said hole having a dimension to tightly receive a pressurized gun for delivering said polymeric foam, and injecting components capable of reacting with each other to form said expandable polymeric foam in an unexpanded state through said hole with said pressurized gun.

15. A method according to claim 14, wherein said foam is a polyurethane foam.

16. A method as defined in claim 14, wherein said floor is a concrete floor.

* * * * *